US008265284B2

(12) United States Patent
Villemoes et al.

(10) Patent No.: US 8,265,284 B2
(45) Date of Patent: Sep. 11, 2012

(54) METHOD AND APPARATUS FOR GENERATING A BINAURAL AUDIO SIGNAL

(75) Inventors: Lars Falck Villemoes, Järfälla (SE); Dirk Jeroen Breebaart, Eindhoven (NL)

(73) Assignees: Koninklijke Philips Electronics N.V., Eindhoven (NL); Dolby International AB, Amsterdam (NL)

( * ) Notice: Subject to any disclaimer, the term of this patent is extended or adjusted under 35 U.S.C. 154(b) by 223 days.

(21) Appl. No.: 12/681,124

(22) PCT Filed: Sep. 30, 2008

(86) PCT No.: PCT/EP2008/008300

§ 371 (c)(1),
(2), (4) Date: Jun. 3, 2010

(87) PCT Pub. No.: WO2009/046909

PCT Pub. Date: Apr. 16, 2009

(65) Prior Publication Data

US 2010/0246832 A1 Sep. 30, 2010

(30) Foreign Application Priority Data

Oct. 9, 2007 (EP) ..... 07118107

(51) Int. Cl.
*H04R 5/00* (2006.01)

(52) U.S. Cl. ..... 381/22

(58) Field of Classification Search ..... 381/19–23; 700/94

See application file for complete search history.

(56) References Cited

U.S. PATENT DOCUMENTS

| | | | |
|---|---|---|---|
| 7,447,629 | B2 | 11/2008 | Breebaart |
| 7,542,896 | B2 | 6/2009 | Schuijers et al. |
| 2007/0223749 | A1 | 9/2007 | Kim et al. |

FOREIGN PATENT DOCUMENTS

| | | | |
|---|---|---|---|
| JP | 2000-308199 | A | 11/2000 |
| JP | 2007-187749 | A | 7/2007 |
| RU | 2005 103 637 | A | 7/2005 |
| RU | 2005 104 123 | A | 7/2005 |

(Continued)

OTHER PUBLICATIONS

Faller, "Parametric Coding of Spatial Audio," Proc. of the 7th Int. Conference of Digital Audio Effects (DAFx'04), Oct. 5-8, 2004, pp. 151-156, Naples, Italy.

(Continued)

*Primary Examiner* — Ping Lee
(74) *Attorney, Agent, or Firm* — Keating & Bennett, LLP

(57) ABSTRACT

An apparatus for generating a binaural audio signal includes a de-multiplexer and decoder which receives audio data comprising an audio M-channel audio signal which is a downmix of an N-channel audio signal and spatial parameter data for upmixing the M-channel audio signal to the N-channel audio signal. A conversion processor converts spatial parameters of the spatial parameter data into first binaural parameters in response to at least one binaural perceptual transfer function. A matrix processor converts the M-channel audio signal into a first stereo signal in response to the first binaural parameters. A stereo filter generates the binaural audio signal by filtering the first stereo signal. The filter coefficients for the stereo filter are determined in response to the at least one binaural perceptual transfer function by a coefficient processor. The combination of parameter conversion/processing and filtering allows a high quality binaural signal to be generated with low complexity.

17 Claims, 6 Drawing Sheets

FOREIGN PATENT DOCUMENTS

| | | | |
|---|---|---|---|
| WO | 2007/031896 | A1 | 3/2007 |
| WO | 2007/096808 | A1 | 8/2007 |

OTHER PUBLICATIONS

Official Communication issued in International Patent Application No. PCT/EP2008/008300, mailed on Jan. 13, 2009.

Breebaart et al., "Multi-Channel Goes Mobile: MPEG Surround Binaural Rendering", AES 29th International Conference, Sep. 2-4, 2006, pp. 1-19, Seoul, Korea.

Herre et al., "Convention Paper 7084—MPEG Surround—The ISO/MPEG Standard for Efficient and Compatible Multi-Channel Audio Coding", Audio Engineering Society, May 5-8, 2007, pp. 1-23, Vienna, Austria.

Breebaart, "Analysis and Synthesis of Binaural Parameters for Efficient 3D Audio Rendering in MPEG Surround", IEEE, 2007, pp. 1878-1881.

Plogsties et al. "MPEG Surround Binaural Rendering-Surround Sound for Mobile Devices", VDT International Convention, Nov. 2006, pp. 1-19, Erlangen, Germany.

Official Communication issued in corresponding Japanese Patent Application No. 2010-528293, mailed on Feb. 28, 2012.

METHOD AND APPARATUS FOR GENERATING A BINAURAL AUDIO SIGNAL

BACKGROUND OF THE INVENTION

The invention relates to a method and apparatus for generating a binaural audio signal and in particular, but not exclusively, to generation of a binaural audio signal from a mono downmix signal.

In the last decade there has been a trend towards multi-channel audio and specifically towards spatial audio extending beyond conventional stereo signals. For example, traditional stereo recordings only comprise two channels whereas modern advanced audio systems typically use five or six channels, as in the popular 5.1 surround sound systems. This provides for a more involved listening experience where the user may be surrounded by sound sources.

Various techniques and standards have been developed for communication of such multi-channel signals. For example, six discrete channels representing a 5.1 surround system may be transmitted in accordance with standards such as the Advanced Audio Coding (AAC) or Dolby Digital standards.

However, in order to provide backwards compatibility, it is known to downmix the higher number of channels to a lower number, and specifically it is frequently used to downmix a 5.1 surround sound signal to a stereo signal allowing a stereo signal to be reproduced by legacy (stereo) decoders and a 5.1 signal by surround sound decoders.

One example is the MPEG2 backwards compatible coding method. A multi-channel signal is downmixed into a stereo signal. Additional signals are encoded in the ancillary data portion allowing an MPEG2 multi-channel decoder to generate a representation of the multi-channel signal. An MPEG1 decoder will disregard the ancillary data and thus only decode the stereo downmix.

There are several parameters which may be used to describe the spatial properties of audio signals. One such parameter is the inter-channel cross-correlation, such as the cross-correlation between the left channel and the right channel for stereo signals. Another parameter is the power ratio of the channels. In so-called (parametric) spatial audio (en)coders, these and other parameters are extracted from the original audio signal in order to produce an audio signal having a reduced number of channels, for example only a single channel, plus a set of parameters describing the spatial properties of the original audio signal. In so-called (parametric) spatial audio decoders, the spatial properties as described by the transmitted spatial parameters are re-instated.

3D sound source positioning is currently gaining interest, especially in the mobile domain. Music playback and sound effects in mobile games can add significant value to the consumer experience when positioned in 3D, effectively creating an 'out-of-head' 3D effect. Specifically, it is known to record and reproduce binaural audio signals which contain specific directional information to which the human ear is sensitive. Binaural recordings are typically made using two microphones mounted in a dummy human head, so that the recorded sound corresponds to the sound captured by the human ear and includes any influences due to the shape of the head and the ears. Binaural recordings differ from stereo (that is, stereophonic) recordings in that the reproduction of a binaural recording is generally intended for a headset or headphones, whereas a stereo recording is generally made for reproduction by loudspeakers. While a binaural recording allows a reproduction of all spatial information using only two channels, a stereo recording would not provide the same spatial perception.

Regular dual channel (stereophonic) or multiple channel (e.g. 5.1) recordings may be transformed into binaural recordings by convolving each regular signal with a set of perceptual transfer functions. Such perceptual transfer functions model the influence of the human head, and possibly other objects, on the signal. A well-known type of spatial perceptual transfer function is the so-called Head-Related Transfer Function (HRTF). An alternative type of spatial perceptual transfer function, which also takes into account reflections caused by the walls, ceiling and floor of a room, is the Binaural Room Impulse Response (BRIR).

Typically, 3D positioning algorithms employ HRTFs (or BRIRs), which describe the transfer from a certain sound source position to the eardrums by means of an impulse response. 3D sound source positioning can be applied to multi-channel signals by means of HRTFs thereby allowing a binaural signal to provide spatial sound information to a user for example using a pair of headphones.

A conventional binaural synthesis algorithm is outlined in FIG. 1. A set of input channels is filtered by a set of HRTFs. Each input signal is split in two signals (a left 'L', and a right 'R' component); each of these signals is subsequently filtered by an HRTF corresponding to the desired sound source position. All left-ear signals are subsequently summed to generate the left binaural output signal, and the right-ear signals are summed to generate the right binaural output signal.

Decoder systems are known that can receive a surround sound encoded signal and generate a surround sound experience from a binaural signal. For example, headphone systems are known which allow a surround sound signal to be converted to a surround sound binaural signal for providing a surround sound experience to the user of the headphones.

FIG. 2 illustrates a system wherein an MPEG surround decoder receives a stereo signal with spatial parametric data. The input bit stream is de-multiplexed by a demultiplexer (201) resulting in spatial parameters and a downmix bit stream. The latter bit stream is decoded using a conventional mono or stereo decoder (203). The decoded downmix is decoded by a spatial decoder (205), which generates a multi-channel output based on the transmitted spatial parameters. Finally, the multi-channel output is then processed by a binaural synthesis stage (207) (similar to that of FIG. 1) resulting in a binaural output signal providing a surround sound experience to the user.

However, such an approach is complex and necessitates substantial computational resource and may further reduce audio quality and introduce audible artifacts.

In order to overcome some of these disadvantages, it has been proposed that a parametric multi-channel audio decoder can be combined with a binaural synthesis algorithm such that a multi-channel signal can be rendered in headphones without requiring that the multi-channel signal is first generated from the transmitted downmix signal followed by a downmix of the multi-channel signal using HRTF filters.

In such decoders, the upmix spatial parameters for recreating the multi-channel signal are combined with the HRTF filters in order to generate combined parameters which can directly be applied to the downmix signal to generate the binaural signal. In order to do so, the HRTF filters are parameterized.

An example of such a decoder is illustrated in FIG. 3 and further described in Breebaart, J. "Analysis and synthesis of binaural parameters for efficient 3D audio rendering in MPEG Surround", Proc. ICME, Beijing, China (2007) and Breebaart, J., Faller, C. "Spatial audio processing: MPEG Surround and other applications", Wiley & Sons, New York (2007).

An input bitstream containing spatial parameters and a downmix signal is received by a demultiplexer 301. The downmix signal is decoded by a conventional decoder 303 resulting in a mono or stereo downmix.

Additionally, HRTF data are converted to the parameter domain by means of a HRTF parameter extraction unit 305. The resulting HRTF parameters are combined in a conversion unit 307 to generate combined parameters referred to as binaural parameters. These parameters describe the combined effect of the spatial parameters and the HRTF processing.

The spatial decoder synthesizes the binaural output signal by modifying the decoded downmix signal dependent on the binaural parameters. Specifically, the downmix signal is transferred to a transform or filter bank domain by a transform unit 309 (or the conventional decoder 303 may directly provide the decoded downmix signal as a transform signal). The transform unit 309 can specifically comprise a QMF filter bank to generate QMF subbands. The subband downmix signal is fed to a matrix unit 311 which performs a 2×2 matrix operation in each sub band.

If the transmitted downmix is a stereo signal the two input signals to the matrix unit 311 are the two stereo signals. If the transmitted downmix is a mono signal one of the input signals to the matrix unit 311 is the mono signal and the other signal is a decorrelated signal (similar to conventional upmixing of a mono signal to a stereo signal).

For both the mono and stereo downmixes, the matrix unit 311 performs the operation:

$$\begin{bmatrix} y_{L_B}^{n,k} \\ y_{R_B}^{n,k} \end{bmatrix} = \begin{bmatrix} h_{11}^{n,k} & h_{12}^{n,k} \\ h_{21}^{n,k} & h_{22}^{n,k} \end{bmatrix} \begin{bmatrix} y_{L_0}^{n,k} \\ y_{R_0}^{n,k} \end{bmatrix},$$

where k is the sub-band index number, n the slot (transform interval) index number, $h_{ij}^{n,k}$ the matrix elements for sub-band k, $y_{L_0}^{n,k}, y_{R_0}^{n,k}$ the two input signals for sub-band k, and $y_{L_B}^{n,k}, y_{R_B}^{n,k}$ the binaural output signal samples.

The matrix unit 311 feeds the binaural output signal samples to an inverse transform unit 313 which transforms the signal back to the time domain. The resulting time domain binaural signal can then be fed to headphones to provide a surround sound experience.

The described approach has a number of advantages:

The HRTF processing can be performed in the transform domain which in many cases can reduce the number of transforms as the same transform domain may be used for decoding the downmix signal.

The complexity of the processing is very low (it uses only multiplication by 2×2 matrices) and is virtually independent on the number of simultaneous audio channels.

It can be applied to both mono and stereo downmixes; HRTFs are represented in a very compact manner and hence can be transmitted and stored very efficiently.

However, the approach also has some disadvantages. Specifically, the approach is only suitable for HRTFs having a relatively short impulse responses (generally less than the transform interval) as longer impulse responses cannot be represented by the parameterised subband HRTF values. Thus, the approach is not usable for audio environments having long echoes or reverberations. Specifically, the approach typically does not work with echoic HRTFs or Binaural Room Impulse Responses (BRIRs) which can be long and thus very hard to correctly model with the parametric approach.

Hence, an improved system for generating a binaural audio signal would be advantageous and in particular a system allowing increased flexibility, improved performance, facilitated implementation, reduced resource usage and/or improved applicability to different audio environments would be advantageous.

SUMMARY

According to an embodiment, an apparatus for generating a binaural audio signal may have: a receiver for receiving audio data having an M-channel audio signal being a downmix of an N-channel audio signal and spatial parameter data for upmixing the M-channel audio signal to the N-channel audio signal; a parameter data converter for converting spatial parameters of the spatial parameter data into first binaural parameters in response to at least one binaural perceptual transfer function; an M-channel converter for converting the M-channel audio signal into a first stereo signal in response to the first binaural parameters; a stereo filter for generating the binaural audio signal by filtering the first stereo signal; and a coefficient determiner for determining filter coefficients for the stereo filter in response to the binaural perceptual transfer function.

According to another embodiment, a method of generating a binaural audio signal may have the steps of: receiving audio data having an M-channel audio signal being a downmix of an N-channel audio signal and spatial parameter data for upmixing the M-channel audio signal to the N-channel audio signal; converting spatial parameters of the spatial parameters data into first binaural parameters in response to at least one binaural perceptual transfer function; converting the M-channel audio signal into a first stereo signal in response to the first binaural parameters; generating the binaural audio signal by filtering the first stereo signal; and determining filter coefficients for the stereo filter in response to the at least one binaural perceptual transfer function.

According to another embodiment, a transmitter for transmitting a binaural audio signal may have: a receiver for receiving audio data having an M-channel audio signal being a downmix of an N-channel audio signal and spatial parameter data for upmixing the M-channel audio signal to the N-channel audio signal; a parameter data converter for converting spatial parameters of the spatial parameter data into first binaural parameters in response to at least one binaural perceptual transfer function; an M-channel converter for converting the M-channel audio signal into a first stereo signal in response to the first binaural parameters; a stereo filter for generating the binaural audio signal by filtering the first stereo signal; a coefficient determiner for determining filter coefficients for the stereo filter in response to the binaural perceptual transfer function; and a transmitter for transmitting the binaural audio signal.

According to another embodiment, a transmission system for transmitting an audio signalmay have: a transmitter having: a receiver for receiving audio data having an M-channel audio signal being a downmix of an N-channel audio signal and spatial parameter data for upmixing the M-channel audio signal to the N-channel audio signal, a parameter data converter for converting spatial parameters of the spatial parameter data into first binaural parameters in response to at least one binaural perceptual transfer function, an M-channel converter for converting the M-channel audio signal into a first stereo signal in response to the first binaural parameters, a stereo filter for generating the binaural audio signal by filtering the first stereo signal, a coefficient determiner for determining filter coefficients for the stereo filter in response to the binaural perceptual transfer function, and a transmitter for transmitting the binaural audio signal; and a receiver for receiving the binaural audio signal.

According to another embodiment, an audio recording device for recording a binaural audio signalmay have: a receiver for receiving audio data having an M-channel audio signal being a downmix of an N-channel audio signal and spatial parameter data for upmixing the M-channel audio signal to the N-channel audio signal; a parameter data converter for converting spatial parameters of the spatial parameter data into first binaural parameters in response to at least one binaural perceptual transfer function; an M-channel converter for converting the M-channel audio signal into a first stereo signal in response to the first binaural parameters; a stereo filter for generating the binaural audio signal by filtering the first stereo signal; a coefficient determiner for determining filter coefficients for the stereo filter in response to the binaural perceptual transfer function; and a recorder for recording the binaural audio signal.

According to another embodiment, a method of transmitting a binaural audio signal may have the steps of: receiving audio data having an M-channel audio signal being a downmix of an N-channel audio signal and spatial parameter data for upmixing the M-channel audio signal to the N-channel audio signal; converting spatial parameters of the spatial parameter data into first binaural parameters in response to at least one binaural perceptual transfer function; converting the M-channel audio signal into a first stereo signal in response to the first binaural parameters; generating the binaural audio signal by filtering the first stereo signal in a stereo filter; determining filter coefficients for the stereo filter in response to the binaural perceptual transfer function; and transmitting the binaural audio signal.

According to another embodiment, a method of transmitting and receiving a binaural audio signal may have: a transmitter performing the steps of: receiving audio data having an M-channel audio signal being a downmix of an N-channel audio signal and spatial parameter data for upmixing the M-channel audio signal to the N-channel audio signal, converting spatial parameters of the spatial parameter data into first binaural parameters in response to at least one binaural perceptual transfer function, converting the M-channel audio signal into a first stereo signal in response to the first binaural parameters, generating the binaural audio signal by filtering the first stereo signal in a stereo filter, determining filter coefficients for the stereo filter in response to the binaural perceptual transfer function, and transmitting the binaural audio signal; and a receiver performing the step of receiving the binaural audio signal.

According to another embodiment, a computer program product may execute a method of transmitting a binaural audio signal, wherein the method may have the steps of: receiving audio data having an M-channel audio signal being a downmix of an N-channel audio signal and spatial parameter data for upmixing the M-channel audio signal to the N-channel audio signal; converting spatial parameters of the spatial parameter data into first binaural parameters in response to at least one binaural perceptual transfer function; converting the M-channel audio signal into a first stereo signal in response to the first binaural parameters; generating the binaural audio signal by filtering the first stereo signal in a stereo filter; determining filter coefficients for the stereo filter in response to the binaural perceptual transfer function; and transmitting the binaural audio signal.

According to another embodiment, a computer program product may execute a method of transmitting and receiving a binaural audio signal, wherein the method may have: a transmitter performing the steps of: receiving audio data having an M-channel audio signal being a downmix of an N-channel audio signal and spatial parameter data for upmixing the M-channel audio signal to the N-channel audio signal, converting spatial parameters of the spatial parameter data into first binaural parameters in response to at least one binaural perceptual transfer function, converting the M-channel audio signal into a first stereo signal in response to the first binaural parameters, generating the binaural audio signal by filtering the first stereo signal in a stereo filter, determining filter coefficients for the stereo filter in response to the binaural perceptual transfer function, and transmitting the binaural audio signal; and a receiver performing the step of receiving the binaural audio signal.

Accordingly, the Invention seeks to mitigate, alleviate or eliminate one or more of the above mentioned disadvantages singly or in any combination.

According to a first aspect of the invention there is provided an apparatus for generating a binaural audio signal, the apparatus comprising: means for receiving audio data comprising an M-channel audio signal being a downmix of an N-channel audio signal and spatial parameter data for upmixing the M-channel audio signal to the N-channel audio signal; parameter data means for converting spatial parameters of the spatial parameter data into first binaural parameters in response to at least one binaural perceptual transfer function; conversion means for converting the M-channel audio signal into a first stereo signal in response to the first binaural parameters; a stereo filter for generating the binaural audio signal by filtering the first stereo signal; and coefficient means for determining filter coefficients for the stereo filter in response to the binaural perceptual transfer function.

The invention may allow an improved binaural audio signal to be generated. In particular, embodiments of the invention may use a combination of frequency and time processing to generate binaural signals reflecting echoic audio environments and/or HRTF or BRIRs with long impulse responses. A low complexity implementation may be achieved. The processing may be implemented with low computational and/or memory resource demands.

The M-channel audio downmix signal may specifically be a mono or stereo signal comprising a downmix of a higher number of spatial channels such as a downmix of a 5.1 or 7.1 surround signal. The spatial parameter data may specifically comprise inter-channel differences and/or cross-correlation differences for the N-channel audio signal. The binaural perceptual transfer function(s) may be HRTF or a BRIR transfer function(s).

According to an optional feature of the invention, the apparatus further comprises transform means for transforming the M-channel audio signal from a time domain to a subband domain and wherein the conversion means and the stereo filter is arranged to individually process each subband of the subband domain.

The feature may provide facilitated implementation, reduced resource demands and/or compatibility with many audio processing applications such as conventional decoding algorithms.

According to an optional feature of the invention, a duration of an impulse response of the binaural perceptual transfer function exceeds a transform update interval.

The invention may allow an improved binaural to signal to be generated and/or may reduce complexity. In particular, the invention may generate binaural signals corresponding to audio environments with long echo or reverberation characteristics.

According to an optional feature of the invention, the conversion means is arranged to generate, for each subband, stereo output samples substantially as:

$$\begin{bmatrix} L_O \\ R_O \end{bmatrix} = \begin{bmatrix} h_{11} & h_{12} \\ h_{21} & h_{22} \end{bmatrix} \begin{bmatrix} L_I \\ R_I \end{bmatrix},$$

wherein at least one of $L_I$ and $R_I$ is a sample of an audio channel of the M-channel audio signal in the subband and the conversion means is arranged to determine matrix coefficients $h_{xy}$ in response to both the spatial parameter data and the at least one binaural perceptual transfer function.

The feature may allow an improved binaural to signal to be generated and/or may reduce complexity.

According to an optional feature of the invention, the coefficient means comprises: means for providing a subband representations of impulse responses of a plurality of binaural perceptual transfer functions corresponding to different sound sources in the N-channel signal; means for determining the filter coefficients by a weighted combination of corresponding coefficients of the subband representations; and means for determining weights for the subband representations for the weighted combination in response to the spatial parameter data.

The invention may allow an improved binaural signal to be generated and/or may reduce complexity. In particular, low complexity yet high quality filter coefficients may be determined.

According to an optional feature of the invention, the first binaural parameters comprise coherence parameters indicative of a correlation between channels of the binaural audio signal.

The feature may allow an improved binaural signal to be generated and/or may reduce complexity. In particular, the desired correlation may be efficiently provided by a low complexity operation prior to filtering. Specifically, a low complexity subband matrix multiplication may be performed to introduce the desired correlation or coherence properties to the binaural signal. Such properties may be introduced prior to the filtering and without requiring the filters to be modified. Thus, the feature may allow correlation or coherence characteristics to be controlled efficiently and with low complexity.

According to an optional feature of the invention, the first binaural parameters do not comprise at least one of localization parameters indicative of a location of any sound source of the binaural audio signal and reverberation parameters indicative of a reverberation of any sound component of the binaural audio signal.

The feature may allow an improved binaural to signal to be generated and/or may reduce complexity. In particular, the feature may allow the localization information and/or reverberation parameters to be controlled exclusively by the filters thereby facilitating the operation and/or providing improved quality. The coherency or correlation of the binaural stereo channels may be controlled by the conversion means thereby allowing the correlation/coherency and localization and/or reverberation to be controlled independently and where it is most practical or efficient.

According to an optional feature of the invention, the coefficient means is arranged to determine the filter coefficients to reflect at least one of localization cues and reverberation cues for the binaural audio signal.

The feature may allow an improved binaural signal to be generated and/or may reduce complexity. In particular, the desired localization or reverberation properties may be efficiently provided by subband filtering thereby providing improved quality and in particular allowing e.g. echoic audio environments to be efficiently simulated.

According to an optional feature of the invention, the audio M-channel audio signal is a mono audio signal and the conversion means is arranged to generate a decorrelated signal from the mono audio signal and to generate the first stereo signal by a matrix multiplication applied to samples of a stereo signal comprising the decorrelated signal and the mono audio signal.

The feature may allow an improved binaural to signal be generated from a mono signal and/or may reduce complexity. In particular, the invention may allow all parameters for generating a high quality binaural audio signal to be generated from typically available spatial parameters.

According to another aspect of the invention, there is provided a method of generating a binaural audio signal, the method comprising: receiving audio data comprising an M-channel audio signal being a downmix of an N-channel audio signal and spatial parameter data for upmixing the M-channel audio signal to the N-channel audio signal; converting spatial parameters of the spatial parameters data into first binaural parameters in response to at least one binaural perceptual transfer function; converting the M-channel audio signal into a first stereo signal in response to the first binaural parameters; generating the binaural audio signal by filtering the first stereo signal; and determining filter coefficients for the stereo filter in response to the at least one binaural perceptual transfer function.

According to another aspect of the invention, there is provided a transmitter for transmitting a binaural audio signal, the transmitter comprising: means for receiving audio data comprising an M-channel audio signal being a downmix of an N-channel audio signal and spatial parameter data for upmixing the M-channel audio signal to the N-channel audio signal; parameter data means for converting spatial parameters of the spatial parameter data into first binaural parameters in response to at least one binaural perceptual transfer function; conversion means for converting the M-channel audio signal into a first stereo signal in response to the first binaural parameters; a stereo filter for generating the binaural audio signal by filtering the first stereo signal; coefficient means for determining filter coefficients for the stereo filter in response to the binaural perceptual transfer function; and means for transmitting the binaural audio signal.

According to another aspect of the invention, there is provided a transmission system for transmitting an audio signal, the transmission system including a transmitter comprising: means for receiving audio data comprising an M-channel audio signal being a downmix of an N-channel audio signal and spatial parameter data for upmixing the M-channel audio signal to the N-channel audio signal, parameter data means for converting spatial parameters of the spatial parameter data into first binaural parameters in response to at least one binaural perceptual transfer function, conversion means for converting the M-channel audio signal into a first stereo signal in response to the first binaural parameters, a stereo filter for generating the binaural audio signal by filtering the first stereo signal, coefficient means for determining filter coefficients for the stereo filter in response to the binaural perceptual transfer function, and means for transmitting the binaural audio signal; and a receiver for receiving the binaural audio signal.

According to another aspect of the invention, there is provided an audio recording device for recording a binaural audio signal, the audio recording device comprising means for receiving audio data comprising an M-channel audio signal being a downmix of an N-channel audio signal and spatial parameter data for upmixing the M-channel audio signal to the N-channel audio signal; parameter data means for converting spatial parameters of the spatial parameter data into first binaural parameters in response to at least one binaural perceptual transfer function; conversion means for converting the M-channel audio signal into a first stereo signal in response to the first binaural parameters; a stereo filter for generating the binaural audio signal by filtering the first stereo signal; coefficient means (419) for determining filter coefficients for the stereo filter in response to the binaural perceptual transfer function; and means for recording the binaural audio signal.

According to another aspect of the invention, there is provided a method of transmitting a binaural audio signal, the method comprising: receiving audio data comprising an M-channel audio signal being a downmix of an N-channel audio signal and spatial parameter data for upmixing the M-channel audio signal to the N-channel audio signal; converting spatial parameters of the spatial parameter data into first binaural parameters in response to at least one binaural perceptual transfer function; converting the M-channel audio signal into a first stereo signal in response to the first binaural parameters; generating the binaural audio signal by filtering the first stereo signal in a stereo filter; determining filter coefficients for the stereo filter in response to the binaural perceptual transfer function; and transmitting the binaural audio signal.

According to another aspect of the invention, there is provided a method of transmitting and receiving a binaural audio signal, the method comprising: a transmitter performing the steps of: receiving audio data comprising an M-channel audio signal being a downmix of an N-channel audio signal and spatial parameter data for upmixing the M-channel audio signal to the N-channel audio signal, converting spatial parameters of the spatial parameter data into first binaural parameters in response to at least one binaural perceptual transfer function, converting the M-channel audio signal into a first stereo signal in response to the first binaural parameters, generating the binaural audio signal by filtering the first stereo signal in a stereo filter, determining filter coefficients for the stereo filter in response to the binaural perceptual transfer function, and transmitting the binaural audio signal; and a receiver performing the step of receiving the binaural audio signal.

According to another aspect of the invention, there is provided a computer program product for executing the method of any of above described methods.

These and other aspects, features and advantages of the invention will be apparent from and elucidated with reference to the embodiment(s) described hereinafter.

BRIEF DESCRIPTION OF THE DRAWINGS

Embodiments of the present invention will be detailed subsequently referring to the appended drawings, in which.

DETAILED DESCRIPTION OF THE INVENTION

The following description focuses on embodiments of the invention applicable to synthesis of a binaural stereo signal from a mono downmix of a plurality of spatial channels. In particular, the description will be appropriate for generation of a binaural signal for headphone reproduction from an MPEG surround sound bit stream encoded using a so-called '5151' configuration that has 5 channels as input (indicated by the first '5'), a mono down mix (the first 'one'), a 5-channel reconstruction (the second '5') and spatial parameterization according to tree structure '1'. Detailed information on different tree structures can be found in Herre, J., Kjörling, K., Breebaart, J., Faller, C., Disch, S., Purnhagen, H., Koppens, J., Hilpert, J., Rödén, J., Oomen, W., Linzmeier, K., Chong, K. S. "MPEG Surround—The ISO/MPEG standard for efficient and compatible multi-channel audio coding", Proc. 122 AES convention, Vienna, Austria (2007) and Breebaart, J., Hotho, G., Koppens, J., Schuijers, E., Oomen, W., van de Par, S. "Background, concept, and architecture of the recent MPEG Surround standard on multi-channel audio compression" J. Audio Engineering Society, 55, p 331-351 (2007), However, it will be appreciated that the invention is not limited to this application but may e.g. be applied to many other audio signals including for example surround sound signals downmixed to a stereo signal.

Figure 3:
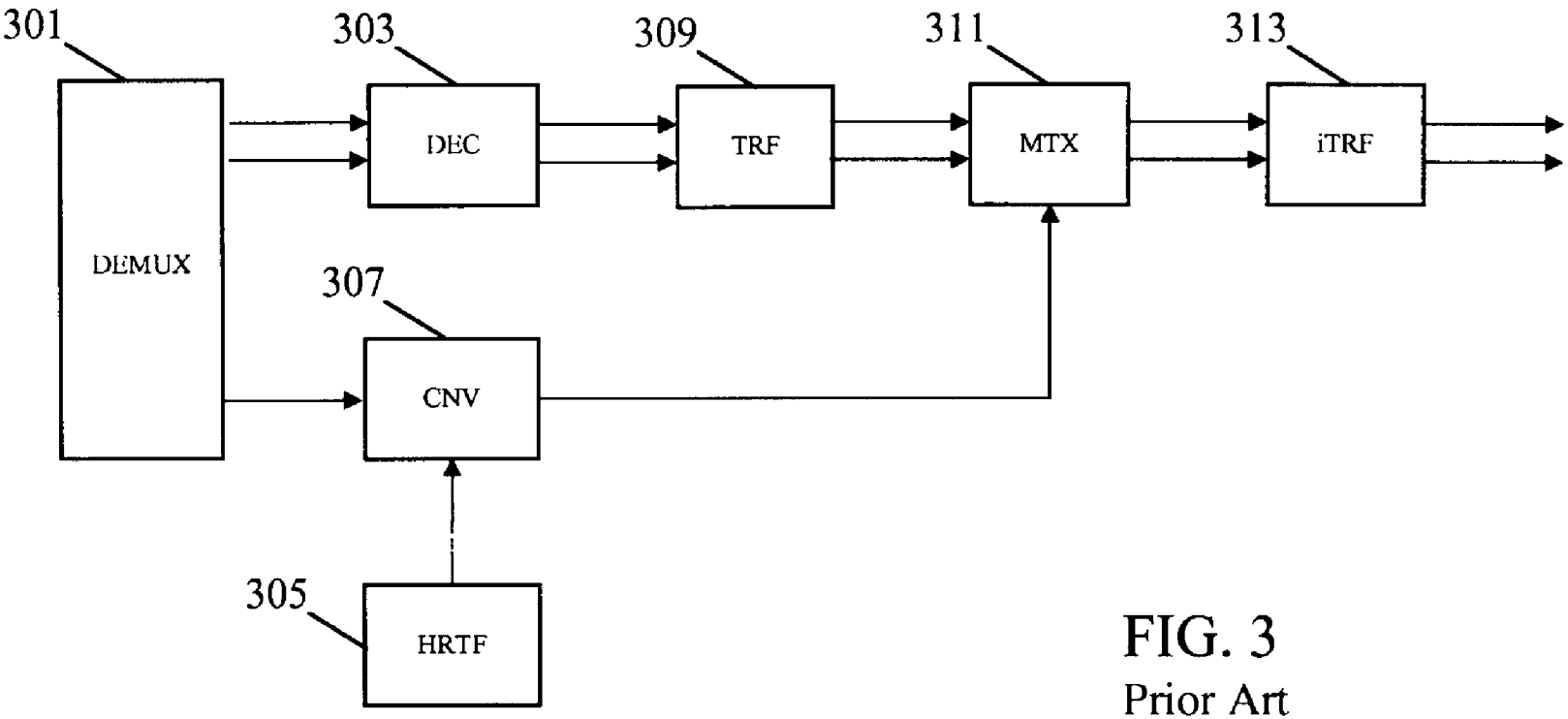
FIG. 3 Prior Art
FIG. 3 is an illustration of an approach for generation of a binaural signal in accordance with conventional technology.

In conventional devices such as that of FIG. 3, long HRTFs or BRIRs cannot be efficiently represented by the parameterized data and matrix operation performed by the matrix unit 311. In effect, the subband matrix multiplications are limited to represent time domain impulse responses having a duration which correspond to the transform time interval used for the transformation to the subband time domain. For example, if the transform is a Fast Fourier Transform (FFT) each FFT interval of N samples is transferred into N subband samples which are fed to the matrix unit. However, impulse responses longer than N samples will not be adequately represented.

One solution to this problem is to use a subband domain filtering approach wherein the matrix operation is replaced by a matrix filtering approach wherein the individual subbands are filtered. Thus, in such embodiments, the subband processing may instead of a simple matrix multiplication be given as:

$$\begin{bmatrix} y_{L_B}^{n,k} \\ y_{R_B}^{n,k} \end{bmatrix} = \sum_{i=0}^{N_q-1} \begin{bmatrix} h_{11}^{n-i,k} & h_{12}^{n-i,k} \\ h_{21}^{n-i,k} & h_{22}^{n-i,k} \end{bmatrix} \begin{bmatrix} y_{L_0}^{n-i,k} \\ y_{R_0}^{n-i,k} \end{bmatrix},$$

where $N_q$ is the number of taps used for the filter to represent the HRTF/BRIR function(s).

Such an approach effectively corresponds to applying four filters to each subband (one for each permutation of input channel and output channel of the matrix unit 311).

Although, such an approach may be advantageous in some embodiments, it also has some associated disadvantages. For example, the system necessitates four filters for each subband which significantly increases the complexity and resource requirements for the processing. Furthermore, in many cases it may be complicated, difficult or even impossible to generate the parameters which accurately correspond to the desired HRTF/BRIR impulse responses.

Specifically, for the simple matrix multiplication of FIG. 3, the coherence of the binaural signal can be estimated with the help of HRTF parameters and transmitted spatial parameters because both parameter types exist in the same (parameter) domain. The coherence of the binaural signal depends on the coherence between individual sound source signals (as described by the spatial parameters), and the acoustical pathway from the individual positions to the eardrums (described by HRTFs). If the relative signal levels, pair-wise coherence values, and HRTF transfer functions are all described in a statistical (parametric) manner, the net coherence resulting from the combined effect of spatial rendering and HRTF processing can be estimated directly in the parameter domain. This process is described in Breebaart, J. "Analysis and synthesis of binaural parameters for efficient 3D audio rendering in MPEG Surround", Proc. ICME, Beijing, China (2007) and Breebaart, J., Faller, C. "Spatial audio processing: MPEG Surround and other applications", Wiley & Sons, New York (2007). If the desired coherence is known, an output signal with a coherence according to the specified value can be obtained by a combination of a decorrelator signal and the mono signal by means of a matrix operation. This process is described in Breebaart, J., van de Par, S., Kohlrausch, A., Schuijers, E. "Parametric coding of stereo audio", EURASIP J. Applied Signal Proc. 9, p 1305-1322 (2005) and Engdegård, J., Purnhagen, H., Rödén, J., Liljeryd, L. "Synthetic ambience in parametric stereo coding", Proc. 116$^{th}$ AES convention, Berlin, Germany (2004).

As a result, the decorrelator signal matrix entries ($h_{12}$ and $h_{22}$) follow from relatively simple relations between spatial and HRTF parameters. However, for filter responses such as those described above, it is significantly more difficult to calculate the net coherence resulting from the spatial decoding and binaural synthesis because the desired coherence value is different for the first part (the direct sound) of the BRIR than for the remaining part (the late reverberation).

Specifically, for BRIRs, the properties can change considerably with time. For example, the first part of a BRIR may describe the direct sound (without room effects). This part is therefore highly directional (with distinct localization properties reflected by e.g. level differences and arrival time differences, and a high coherence). The early reflections and late reverberation, on the other hand, are often relatively less directional. Thus, the level differences between the ears are less pronounced, the arrival time differences are difficult to determine accurately due to the stochastic nature of these, and the coherence is in many cases quite low. This change of localization properties is quite important to capture accurately but this may be difficult because it would necessitate that the coherence of the filter responses are changed depending on the position within the actual filter response, while at the same time the full filter response should depend on the spatial parameters and the HRTF coefficients. This combination of requirements is very difficult to fulfill with a limited number of processing steps.

In summary, determining the correct coherence between the binaural output signals and ensuring its correct temporal behavior is very difficult for a mono downmix and is typically impossible using the approaches known for the matrix multiplication approach of the conventional technology.

Figure 4:
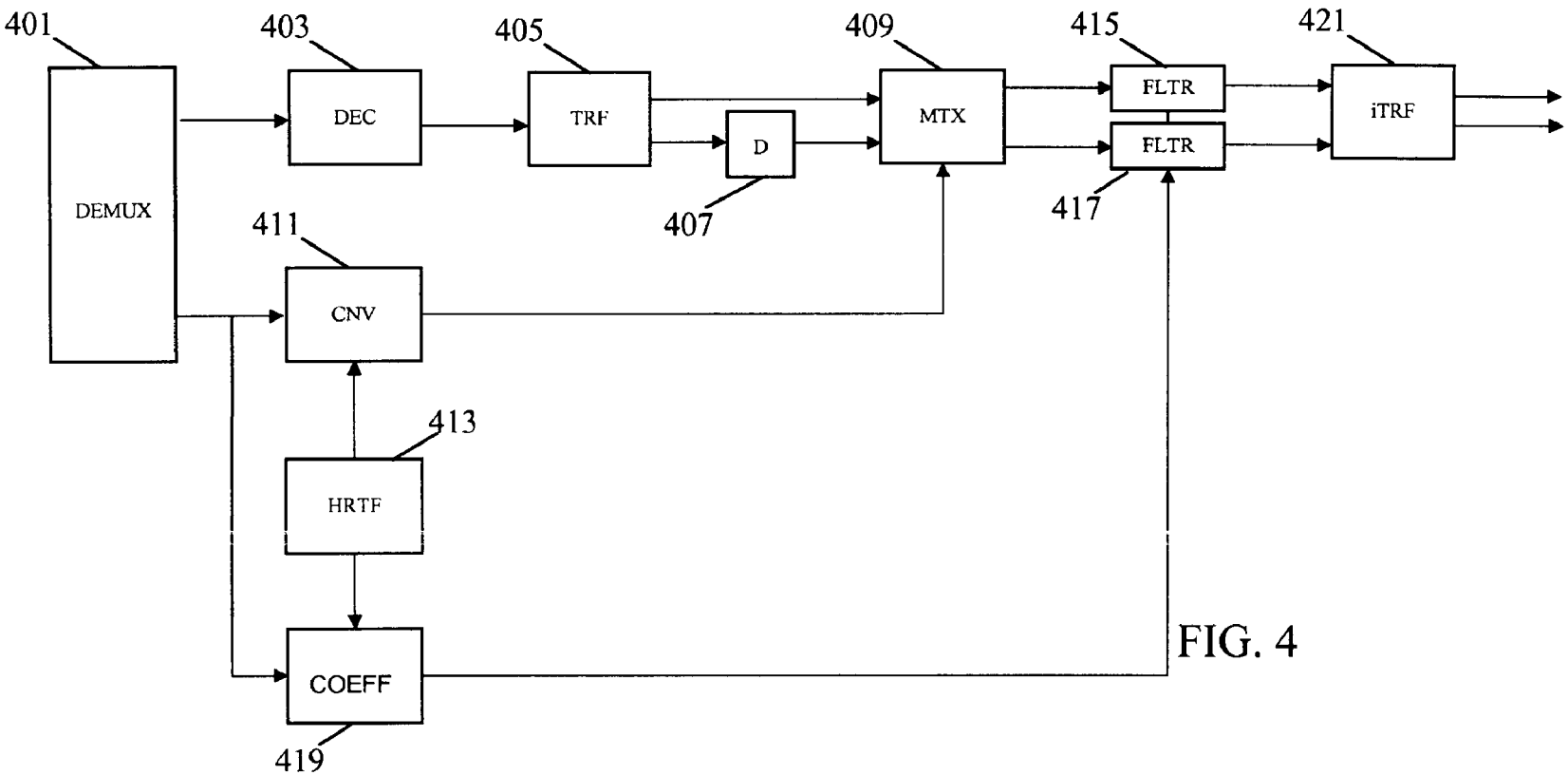
FIG. 4 illustrates a device for generating a binaural audio signal in accordance with some embodiments of the invention.

FIG. 4 illustrates a device for generating a binaural audio signal in accordance with some embodiments of the invention. In the described approach, parametric matrix multiplication is combined with low complexity filtering to allow audio environments with long echo or reverberation to be emulated. In particular, the system allows long HRTFs/BRIRs to be used while maintaining low complexity and practical implementation.

The device comprises a demultiplexer 401 which receives an audio data bit stream which comprises an audio M-channel audio signal which is a downmix of an N-channel audio signal. In addition, the data comprises spatial parameter data for upmixing the M-channel audio signal to the N-channel audio signal. In the specific example, the downmix signal is a mono signal i.e. M=1 and the N-channel audio signal is a 5.1 surround signal, i.e. N=6. The audio data is specifically an MPEG Surround encoding of a surround signal and the spatial data comprises Inter Level Differences (ILDs) and Interchannel Cross-Correlation (ICC) parameters.

The audio data of the mono signal is fed to a decoder 403 coupled to the demultiplexer 401. The decoder 403 decodes the mono signal using a suitable conventional decoding algorithm as will be well known to the person skilled in the art. Thus, in the example, the output of the decoder 403 is a decoded mono audio signal.

The decoder 403 is coupled to a transform processor 405 which is operable to convert the decoded mono signal from the time domain to a frequency subband domain. In some embodiments, the transform processor 405 may be arranged to divide the signal into transform intervals (corresponding to sample blocks comprising a suitable number of samples) and perform a Fast Fourier Transform (FFT) in each transform time interval. For example, the FFT may be a 64 point FFT with the mono audio samples being divided into 64 sample blocks to which the FFT is applied to generate 64 complex subband samples.

In the specific example, the transform processor 405 comprises a QMF filter bank operating with a 64 samples transform interval. Thus, for each block of 64 time domain samples, 64 subband samples are generated in the frequency domain.

In the example, the received signal is a mono signal which is to be upmixed to a binaural stereo signal. Accordingly, the frequency subband mono signal is fed to a decorrelator 407 which generates a de-correlated version of the mono signal. It will be appreciated that any suitable method of generating a de-correlated signal may be used without detracting from the invention.

The transform processor 405 and decorrelator 407 are fed to a matrix processor 409. Thus, the matrix processor 409 is fed the subband representation of the mono signal as well as the subband representation of the generated decorrelated signal. The matrix processor 409 proceeds to convert the mono signal into a first stereo signal. Specifically, the matrix processor 409 performs a matrix multiplication in each subband given by:

$$\begin{bmatrix} L_o \\ R_o \end{bmatrix} = \begin{bmatrix} h_{11} & h_{12} \\ h_{21} & h_{22} \end{bmatrix} \begin{bmatrix} L_I \\ R_I \end{bmatrix},$$

wherein $L_I$ and $R_I$ are the sample of the input signals to the matrix processor 409, i.e. in the specific example $L_I$ and $R_I$ are the subband samples of the mono signal and the decorrelated signal.

The conversion performed by the matrix processor 409 depends on the binaural parameters generated in response to the HRTFs/BRIRs. In the example, the conversion also depends on the spatial parameters that relate the received mono signal and the (additional) spatial channels.

Specifically, the matrix processor 409 is coupled to a conversion processor 411 which is furthermore coupled to the demultiplexer 401 and an HRTF store 413 comprising the data representing the desired HRTF(s) (or equivalently the desired BRIR(s). The following will for brevity only refer to HRTF(s) but it will appreciated that BRIR(s) may be used instead of (or as well as) HRTFs). The conversion processor 411 receives the spatial data from the demultiplexer and the data representing the HRTF from the HRTF store 413. The conversion processor 411 then proceeds to generate the binaural parameters used by the matrix processor 409 by converting the spatial parameters into the first binaural parameters in response to the HRTF data.

However, in the example, the full parameterization of the HRTF and spatial parameters to generate an output binaural signal is not calculated. Rather, the binaural parameters used in the matrix multiplication only reflect part of the desired HRTF response. In particular, the binaural parameters are estimated for the direct part (excluding early reflections and late reverberation) of the HRTF/BRIR only. This is achieved using the conventional parameter estimation process, using the first peak of the HRTF time-domain impulse response only during the HRTF parameterization process. Only the resulting coherence for the direct part (excluding localization cues such as level and/or time differences) is subsequently used in the 2×2 matrix. Indeed, in the specific example, the matrix coefficients are generated to only reflect the desired coherence or correlation of the binaural signal and do not include consideration of the localization or reverberation characteristics.

Thus the matrix multiplication only performs part of the desired processing and the output of the matrix processor 409 is not the final binaural signal but is rather an intermediate (binaural) signal that reflects the desired coherence of the direct sound between the channels.

The binaural parameters in the form of the matrix coefficients $h_{xy}$ are in the example generated by first calculating the relative signal powers in the different audio channels of the N-channel signal based on the spatial data and specifically based on level difference parameters contained therein. The relative powers in each of the binaural channels are then calculated based on these values and the HRTFs associated with each of the N channels. Also, an expected value for the cross correlation between the binaural signals is calculated based on the signal powers in each of the N-channels and the HRTFs. Based on the cross correlation and the combined power of the binaural signal, a coherence measure for the channel is subsequently calculated and the matrix parameters are determined to provide this correlation. Specific details of how the binaural parameters can be generated will be described later.

The matrix processor 409 is coupled to two filters 415, 417 which are operable to generate the output binaural audio signal by filtering the stereo signal generated by the matrix processor 409. Specifically, each of the two signals is filtered individually as a mono signal and no cross coupling of any signal from one channel to the other is introduced. Accordingly, only two mono filters are employed thereby reducing complexity compared to e.g. approaches necessitating four filters.

The filters 415, 417 are subband filters where each subband is individually filtered. Specifically, each of the filters may be Finite Impulse Response (FIR) filters, in each subband performing a filtering given substantially by:

$$z^{n,k} = \sum_{i=0}^{N_q-1} c_i^k \cdot y_0^{n-i,k}$$

where y represents the subband samples received from the matrix processor 409, c are the filter coefficients, n is the sample number (corresponding to the transform interval number), k is the subband and N is the length of the impulse response of the filter. Thus, in each individual subband, a "time domain" filtering is performed thereby extending the processing from being in a single transform interval to take into account subband samples from a plurality of transform intervals.

The signal modifications of MPEG surround are performed in the domain of a complex modulated filter bank, the QMF, which is not critically sampled. Its particular design allows for a given time domain filter to be implemented at high precision by filtering each subband signal in the time direction with a separate filter. The resulting overall SNR for the filter implementation is in the 50 dB range with the aliasing part of the error significantly smaller. Moreover, these subband domain filters can be derived directly from the given time domain filter. A particularly attractive method to compute the subband domain filter corresponding to a time domain filter h(v) is to use a second complex modulated analysis filter bank with a FIR prototype filter q(v) derived from the prototype filter of the QMF filter bank. Specifically, $$c_i^k = \sum_v h(v + iL)q(v)\exp\left(-j\frac{\pi}{L}\left(k + \frac{1}{2}\right)v\right),$$

where L=64. For the MPEG Surround QMF bank, the filter converter prototype filter q(v) has 192 taps. As an example, a time domain filter with 1024 taps will be converted into a set of 64 subband filters all having 18 taps in the time direction.

The filter characteristics are in the example generated to reflect both aspects of the spatial parameters as well as aspects of the desired HRTFs. Specifically, the filter coefficients are determined in response to the HRTF impulse responses and the spatial location cues such that the reverberation and localization characteristics of the generated binaural signal are introduced and controlled by the filters. The correlation or coherency of the direct part of the binaural signals are not affected by the filtering assuming that the direct part of the filters is (almost) coherent and hence the coherence of the direct sound of the binaural output is fully defined by the preceding matrix operation. The late-reverberation part of the filters, on the other hand, is assumed to be uncorrelated between the left and right-ear filters and hence the output of that specific part will be uncorrelated, independent of the coherence of the signal fed into these filters. Hence no modification is required for the filters in response to the desired coherency. Thus, the matrix operation proceeding the filters determines the desired coherence of the direct part, while the remaining reverberation part will automatically have the correct (low) correlation, independent of the actual matrix values. Thus, the filtering maintains the desired coherency introduced by the matrix processor 409.

Thus, in the device of FIG. 4, the binaural parameters (in the form of the matrix coefficients) used by the matrix processor 409 are coherence parameters indicative of a correlation between channels of the binaural audio signal. However, these parameters do not comprise localization parameters indicative of a location of any sound source of the binaural audio signal or reverberation parameters indicative of a reverberation of any sound component of the binaural audio signal. Rather these parameters/characteristics are introduced by the subsequent subband filtering by determining the filter coefficients such that they reflect the localization cues and reverberation cues for the binaural audio signal.

Specifically, the filters are coupled to a coefficient processor 419 which is further coupled to the demultiplexer 401 and the HRTF store 413. The coefficient processor 419 determines the filter coefficients for the stereo filter 415, 417 in response to the binaural perceptual transfer function(s). Furthermore, the coefficient processor 419 receives the spatial data from the demultiplexer 401 and uses this to determine the filter coefficients.

Specifically, the HRTF impulse responses are converted to the subband domain and as the impulse response exceeds a single transform interval this results in an impulse response for each channel in each subband rather than in a single subband coefficient. The impulse responses for each HRTF filter corresponding to each of the N channels are then summed in a weighted summation. The weights that are applied to each of the N HRTF filter impulse responses are determined in response to the spatial data and are specifically determined to result in the appropriate power distribution between the different channels. Specific details of how the filter coefficients can be generated will be described later.

The output of the filters 415, 417 is thus a stereo subband representation of a binaural audio signal that effectively emulates a full surround signal when presented in headphones. The filters 415, 417 are coupled to an inverse transform processor 421 which performs an inverse transform to convert the subband signal to the time domain. Specifically, the inverse transform processor 421 may perform an inverse QMF transform.

Thus, the output of the inverse transform processor 421 is a binaural signal which can provide a surround sound experience from a set of headphones. The signal may for example be encoded using a conventional stereo encoder and/or may be converted to the analog domain in an analog to digital converter to provide a signal that can be fed directly to headphones.

Thus, the device of FIG. 4 combines parametric HRTF matrix processing and subband filtering to provide a binaural signal. The separation of a correlation/coherence matrix multiplication and a filter based localization and reverberation filtering provides a system wherein the parameters can be readily computed for e.g. a mono signal. Specifically, in contrast to a pure filtering approach where the coherency parameter is difficult or impossible to determine and implement, the combination of different types of processing allows the coherency to be efficiently controlled even for applications based on a mono downmix signal.

Thus, the described approach has the advantage that the synthesis of the correct coherence (by means of the matrix multiplication) and the generation of localization cues and reverberation (by means of the filters) is completely separated and controlled independently. Furthermore, the number of filters is limited to two as no cross channel filtering is required. As the filters are typically more complex than the simple matrix multiplication, the complexity is reduced.

In the following, a specific example of how the matrix binaural parameters and filter coefficients can be calculated will be described. In the example, the received signal is an MPEG surround bit stream encoded using a '5151' tree structure.

In the description the following acronyms will be used:

l or L: Left channel r or R: Right channel f: Front channel(s)

s: Surround channel (s)

C: Center channel ls: Left Surround rs: Right Surround lf: Left Front lr: Left Right The spatial data comprises in the MPEG data stream includes the following parameters:

| Parameter | Description |
|---|---|
| $_{fs}$ | Level difference front vs surround |
| $CLD_{fc}$ | Level difference front vs center |
| $CLD_f$ | Level difference front left vs front right |
| $CLD_s$ | Level difference surround left vs surround right |
| $ICC_{fs}$ | Correlation front vs surround |
| $ICC_{fc}$ | Correlation front vs center |
| $ICC_f$ | Correlation front left vs front right |
| $ICC_s$ | Correlation surround left vs surround right |
| $CLD_{lfe}$ | Level difference center vs LFE |

Firstly, the generation of the binaural parameters used for the matrix multiplication by the matrix processor 409 will be described.

The conversion processor 411 first calculates an estimate of the binaural coherence which is a parameter reflecting the desired coherency between the channels of the binaural output signal. The estimation uses the spatial parameters as well as HRTF parameters determined for the HRTF functions.

Specifically, the following HRTF parameters are used:

$P_l$ which is the rms power within a certain frequency band of an HRTF corresponding to the left ear $P_r$ which is the rms power within a certain frequency band of an HRTF corresponding to the right ear ρ which is the coherence within a certain frequency band between the left and right-ear HRTF for a certain virtual sound source position ϕ which is the average phase difference within a certain frequency band between the left and right-ear HRTF for a certain virtual sound source position Assuming frequency-domain HRTF representation $H_l(f)$, $H_r(f)$, for the left and right ears, respectively, and f the frequency index, these parameters can be calculated according to:

$$P_l = \sqrt{\sum_{f=f(b)}^{f=f(b+1)-1} H_l(f)H_l^*(f)}$$

$$P_r = \sqrt{\sum_{f=f(b)}^{f=f(b+1)-1} H_r(f)H_r^*(f)}$$

-continued $$\varphi = \arg\left(\sum_{f=f(b)}^{f=f(b+1)-1} H_l(f)H_r^*(f)\right)$$

$$\rho = \frac{\left|\sum_{f=f(b)}^{f=f(b+1)-1} H_l(f)H_r^*(f)\right|}{P_l P_r}$$

Where summation across f is performed for each parameter band to result in one set of parameters for each parameter band b. More information on this HRTF parameterization process can be obtained from Breebaart, J. "Analysis and synthesis of binaural parameters for efficient 3D audio rendering in MPEG Surround", Proc. ICME, Beijing, China (2007) and Breebaart, J., Faller, C. "Spatial audio processing: MPEG Surround and other applications", Wiley & Sons, New York (2007).

The above parameterization process is performed independently for each parameter band and each virtual loudspeaker position. In the following, the loudspeaker position is denoted by $P_l(X)$, with X the loudspeaker identifier (lf, rf, c, ls or ls).

As a first step, the relative powers (with respect to the power of the mono input signal) of the 5.1-channel signal are computed using the transmitted CLD parameters. The relative power of the left-front channel is given by:

$$\sigma_{lf}^2 = r_1(CLD_{fs})r_1(CLD_{fc})r_1(CLD_f),$$

with $$r_1(CLD) = \frac{10^{CLD/10}}{1+10^{CLD/10}},$$

and $$r_2(CLD) = \frac{1}{1+10^{CLD/10}}.$$

Similarly, the relative powers of the other channels are given by:

$$\sigma_{rf}^2 = r_1(CLD_{fs})r_1(CLD_{fc})r_2(CLD_f)$$

$$\sigma_c^2 = r_1(CLD_{fs})r_2(CLD_{fc})$$

$$\sigma_{ls}^2 = r_2(CLD_{fs})r_1(CLD_s)$$

$$\sigma_{rs}^2 = r_2(CLD_{fs})r_2(CLD_s)$$

Given the powers σ of each virtual speaker, the ICC parameters that represent coherence values between certain speaker pairs, and the HRTF parameters $P_l$, $P_r$, ρ, and (φ for each virtual loudspeaker, the statistical attributes of the resulting binaural signal can be estimated. This is achieved by adding the contribution in terms of power σ for each virtual loudspeaker, multiplied by the power of the HRTF $P_l$, $P_r$ for each ear individually to reflect the change in power introduced by the HRTF. Additional terms may be needed to incorporate the effect of mutual correlations between virtual loudspeaker signals (ICC) and the pathlength differences of the HRTF (represented by the parameter φ) (ref. e.g. Breebaart, J., Faller, C. "Spatial audio processing: MPEG Surround and other applications", Wiley & Sons, New York (2007)).

The expected value of the relative power of the left binaural output channel $\sigma_L^2$ (with respect to the mono input channel) is given by:

$$\sigma_L^2 = P_l^2(C)\sigma_c^2 + P_l^2(Lf)\sigma_{lf}^2 + P_l^2(Ls)\sigma_{ls}^2 + P_l^2(Rf)\sigma_{rf}^2 + P_l^2(Rs)\sigma_{rs}^2 + \ldots\ 2P_l(Lf)P_l(Rf)\rho(Rf)\sigma_{lf}\sigma_{rf}ICC_f\cos(\phi(Rf)) + \ldots\ 2P_l(Ls)P_l(Rs)\rho(Rs)\sigma_{ls}\sigma_{rs}ICC_s\cos(\phi(Rs))$$

Similarly, the (relative) power for the right channel is given by:

$$\sigma_R^2 = P_r^2(C)\sigma_c^2 + P_r^2(Lf)\sigma_{lf}^2 + P_r^2(Ls)\sigma_{ls}^2 + P_r^2(Rf)\sigma_{rf}^2 + P_r^2(Rs)\sigma_{rs}^2 + \ldots\ 2P_r(Lf)P_r(Rf)\rho(Lf)\sigma_{lf}\sigma_{rf}ICC_f\cos(\phi(Lf)) + \ldots\ 2P_r(Ls)P_r(Rs)\rho(Ls)\sigma_{ls}\sigma_{rs}ICC_s\cos(\phi(Ls))$$

Based on similar assumptions and using similar techniques, the expected value for the cross product $L_B R_B^*$ of the binaural signal pair can be calculated from $$\begin{aligned}\langle L_B R_B^*\rangle = {} & \sigma_c^2 P_l(C)P_r(C)\rho(C)\exp(j\phi(C)) + \ldots\ \sigma_{lf}^2 P_l(Lf)P_r(Lf)\rho(Lf)\exp(j\phi(Lf)) + \\ & \ldots\ \sigma_{rf}^2 P_l(Rf)P_r(Rf)\rho(Rf)\exp(j\phi(Rf)) + \\ & \ldots\ \sigma_{ls}^2 P_l(Ls)P_r(Ls)\rho(Ls)\exp(j\phi(Ls)) + \\ & \ldots\ \sigma_{rs}^2 P_l(Rs)P_r(Rs)\rho(Rs)\exp(j\phi(Rs)) + \\ & \ldots\ P_l(Lf)P_r(Rf)\sigma_{lf}\sigma_{rf}ICC_f + \ldots\ P_l(Ls)P_r(Rs)\sigma_{ls}\sigma_{rs}ICC_s + \\ & \ldots\ P_l(Rs)P_r(Ls)\sigma_{ls}\sigma_{rs}ICC_s\rho(Ls)\rho(Rs)\exp(j(\phi(Rs)+\phi(Ls))) + \\ & \ldots\ P_l(Rf)P_r(Lf)\sigma_{lf}\sigma_{rf}ICC_f\rho(Lf)\rho(Rf)\exp(j(\phi(Rf)+\phi(Lf)))\end{aligned}$$

The coherence of the binaural output ($ICC_B$) is then given by:

$$ICC_B = \frac{|\langle L_B R_B^*\rangle|}{\sigma_L\sigma_R},$$

Based on the determined coherence of the binaural output signal $ICC_B$ (and ignoring the localization cues and reverberation characteristics) the matrix coefficients to re-instate the $ICC_B$ parameters can then be calculated using conventional methods as specified in Breebaart, J., van de Par, S., Kohlrausch, A., Schuijers, E. "Parametric coding of stereo audio", EURASIP J. Applied Signal Proc. 9, p 1305-1322 (2005):

$$h_{11} = \cos(\alpha+\beta)$$

$$h_{12} = \sin(\alpha+\beta)$$

$$h_{21} = \cos(-\alpha+\beta)$$

$$h_{22} = \sin(-\alpha+\beta)$$

with $$\alpha = 0.5\arccos(ICC_B)$$

$$\beta = \arctan\left(\frac{\sigma_R-\sigma_L}{\sigma_R+\sigma_L}\tan(\alpha)\right)$$

In the following the generation of the filter coefficients by the coefficient processor 419 will be described.

Firstly, subband representations of impulse responses of the binaural perceptual transfer function corresponding to different sound sources in the binaural audio signal are generated.

Specifically, the HRTFs (or BRIRs) are converted to the QMF domain resulting in QMF-domain representations $H_{L,X}^{n,k}$,$H_{R,X}^{n,k}$ for the left ear and right ear impulse responses, respectively, by using the filter converter method outlined above in the description of FIG. 4. In the representation X denotes the source channel (X=Lf, Rf, C, Ls, Rs), R and L denotes the left and right binaural channel respectively, n is the transform block number and k denotes the subband.

The coefficient processor 419 then proceeds to determine the filter coefficients as a weighted combination of corresponding coefficients of the subband representations $H_{L,X}^{n,k}$, $H_{R,X}^{n,k}$. Specifically, the filter coefficients for the FIR filters 415, 417 $H_{L,M}^{n,k}$,$H_{R,M}^{n,k}$ are given by:

$$H_{L,M}^{n,k}=g_L^k\cdot(t_{Lf}^k H_{L,Lf}^{n,k}+t_{Ls}^k H_{L,Ls}^{n,k}+t_{Rf}^k H_{L,Rf}^{n,k}+t_{Rs}^k H_{L,Ls}^{n,k}+t_C^k H_{L,C}^{n,k}),$$

$$H_{R,M}^{n,k}=g_R^k\cdot(s_{Lf}^k H_{R,Lf}^{n,k}+s_{Ls}^k H_{R,Ls}^{n,k}+s_{Rf}^k H_{R,Rf}^{n,k}+s_{Rs}^k H_{R,Rs}^{n,k}+s_C^k H_{R,C}^{n,k}).$$

The coefficient processor 419 calculates the weights $t^k$ and $s^k$ as described in the following.

Firstly, the modulus' of the linear combination weights are chosen such that:

$$|t_X^k|=\sigma_X^k, |s_X^k|=\sigma_X^k$$

Thus, the weight for a given HRTF corresponding to a given spatial channel is selected to correspond to the power level of that channel.

Secondly, the scaling gains $g_Y^k$ are computed as follows.

Let the normalized target binaural output power for the hybrid band k be denoted by $(\sigma_Y^k)^2$ for the output channel Y=L,R, and let the power gain of the filter $H_{Y,M}^{n,k}$ be denoted by $(\sigma_{Y,M}^k)^2$, then the scaling gains $g_Y^k$ are adjusted in order to achieve $$\sigma_{Y,M}^k=\sigma_Y^k.$$

Note here that if this can be achieved approximately with scaling gains that are constant in each parameter band, then the scaling can be omitted from the filter morphing and performed by modifying the matrix elements of the previous section to $$h_{11}=g_L\cos(\alpha+\beta)$$

$$h_{12}=g_L\sin(\alpha+\beta)$$

$$H_{21}=g_R\cos(-\alpha+\beta)$$

$$H_{22}=g_R\sin(-\alpha+\beta).$$

For this to hold true, it is a requirement that the unscaled weighted combination $$t_{Lf}^k H_{L,Lf}^{n,k}+t_{Ls}^k H_{L,Ls}^{n,k}+t_{Rf}^k H_{L,Rf}^{n,k}+t_{Rs}^k H_{L,Rs}^{n,k}+t_C^k H_{L,C}^{n,k}$$

$$s_{Lf}^k H_{R,Lf}^{n,k}+s_{Ls}^k H_{R,Ls}^{n,k}+s_{Rf}^k H_{R,Rf}^{n,k}+s_{Rs}^k H_{R,Rs}^{n,k}+s_C^k H_{R,C}^{n,k}$$

have power gains that do not vary too much inside parameter bands. Typically, a main contribution to such variations arises from the main delay differences between the HRTF responses. In some embodiments of the present invention, a pre-alignment in the time domain is performed for the dominating HRTF filters and the simple real valued combination weights can be applied:

$$t_X^k=s_X^k=\sigma_X^k.$$

In other embodiments of the present invention, those delay differences are adaptively counteracted on the dominating HRTF pairs, by means of introducing complex valued weights. In the case of front/back pairs this amount to the use of the following weights:

$$t_{Lf}^k=\sigma_{Lf}^k\exp\left[-j\phi_{Lf,Ls}^{L,k}\frac{(\sigma_{Ls}^k)^2}{(\sigma_{Lf}^k)^2+(\sigma_{Ls}^k)^2}\right],$$

$$t_{Ls}^k=\sigma_{Ls}^k\exp\left[j\phi_{Lf,Ls}^{L,k}\frac{(\sigma_{Lf}^k)^2}{(\sigma_{Lf}^k)^2+(\sigma_{Ls}^k)^2}\right],$$

and $t_X^k=\sigma_X^k$ for X=C,Rf,Rs.

$$s_{Rf}^k=\sigma_{Rf}^k\exp\left[-j\phi_{Rf,Rs}^{R,k}\frac{(\sigma_{Rs}^k)^2}{(\sigma_{Rf}^k)^2+(\sigma_{Rs}^k)^2}\right],$$

$$s_{Rs}^k=\sigma_{Rs}^k\exp\left[j\phi_{Rf,Rs}^{R,k}\frac{(\sigma_{Rf}^k)^2}{(\sigma_{Rf}^k)^2+(\sigma_{Rs}^k)^2}\right],$$

$$\text{and } s_X^k=\sigma_X^k \text{ for } X=C, Lf, Ls.$$

Here $\phi_{Xf,Xs}^{X,k}$ is the unwrapped phase angle of the complex cross correlation between the subband filters $H_{X,Xf}^{n,k}$ and $H_{X,Xs}^{n,k}$ This cross correlation is defined by $$(CIC)_k=\frac{\sum_n (H_{X,Xf}^{n,k})(H_{X,Xs}^{n,k})^*}{\left(\sum_n |H_{X,Xf}^{n,k}|^2\right)^{1/2}\left(\sum_n |H_{X,Xs}^{n,k}|^2\right)^{1/2}},$$

where the star denotes complex conjugation.

The purpose of the phase unwrapping is to use the freedom in the choice of a phase angle up to multiples of 2π in order to obtain a phase curve which is varying as slowly as possible as a function of the subband index k.

The role of the phase angle parameters in the combination formulas above is twofold. First, it realizes a delay compensation of the front/back filters prior to superposition which leads to a combined response which models a main delay time corresponding to a source position between the front and the back speakers. Second, it reduces the variability of the power gains of the unscaled filters.

If the coherence $ICC_M$ of the combined filters $H_{L,M}$, $H_{R,M}$ in a parameter band or a hybrid band is less than one, the binaural output can become less coherent then intended, as it follows from the relation $$ICC_{B,Out}=ICC_M\cdot ICC_B.$$

The solution to this problem in accordance with some embodiments of the present invention is to use a modified $ICC_B$-value for the matrix element definition, defined by $$ICC'_B = \min\left\{1, \frac{ICC_B}{ICC_M}\right\}.$$

Figure 5:
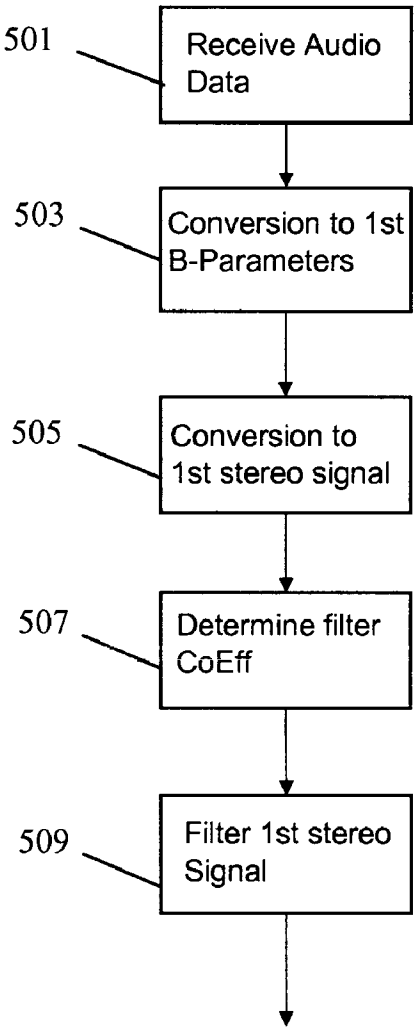
FIG. 5 illustrates a flow chart of an example of a method of generating a binaural audio signal in accordance with some embodiments of the invention.

FIG. 5 illustrates a flow chart of an example of a method of generating a binaural audio signal in accordance with some embodiments of the invention.

The method starts in step 501 wherein audio data is received comprising an audio M-channel audio signal being a downmix of an N channel audio signal and spatial parameter data for upmixing the M-channel audio signal to the N channel audio signal.

Step 501 is followed by step 503 wherein the spatial parameters of the spatial parameter data is converted into first binaural parameters in response to a binaural perceptual transfer function.

Step 503 is followed by step 505 wherein the M-channel audio signal is converted into a first stereo signal in response to the first binaural parameters.

Step 505 is followed by step 507 wherein filter coefficients are determined for a stereo filter in response to the binaural perceptual transfer function.

Step 507 is followed by step 509 wherein the binaural audio signal is generated by filtering the first stereo signal in the stereo filter.

Figure 6:
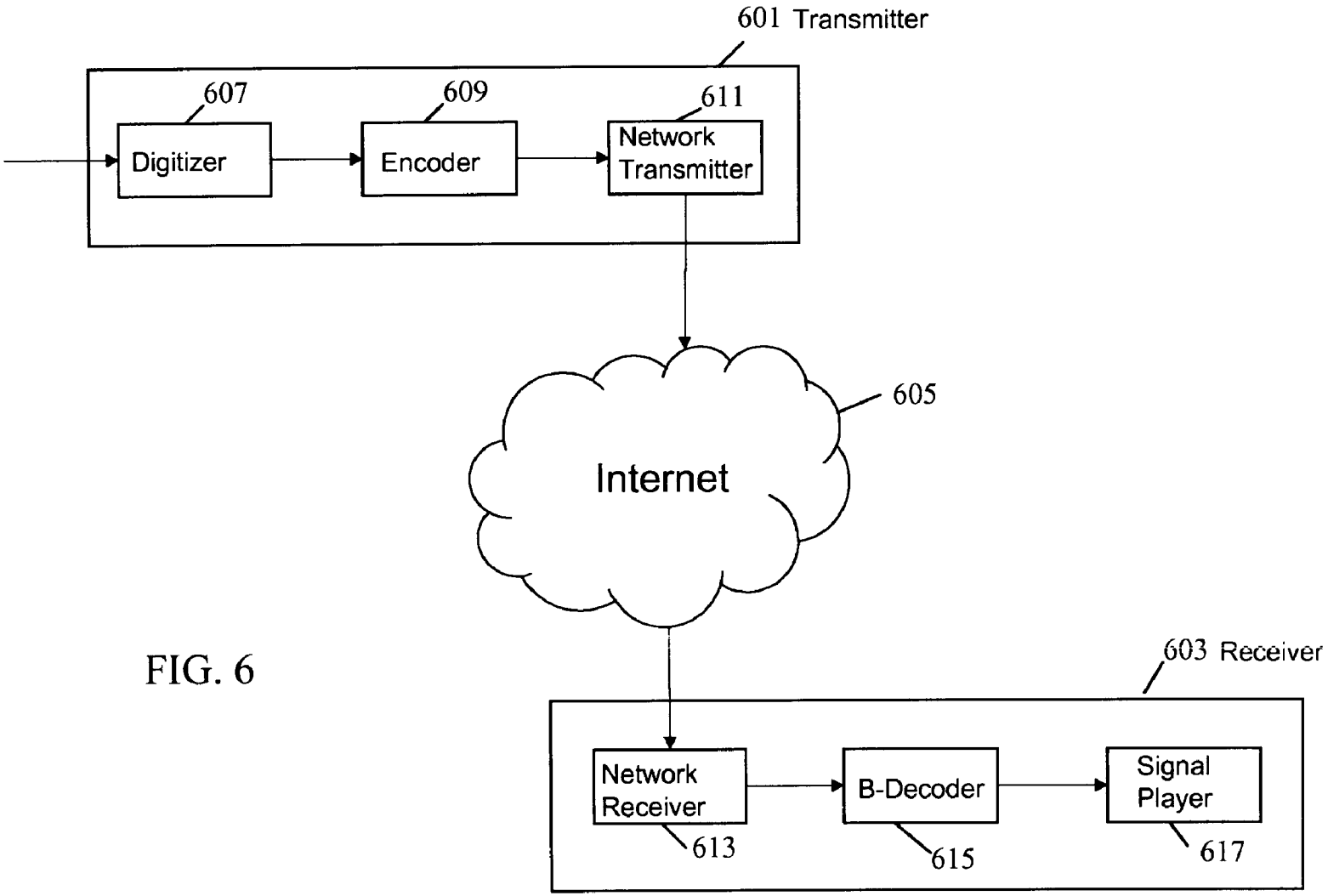
FIG. 6 illustrates an example of a transmission system for communication of an audio signal in accordance with some embodiments of the invention

The apparatus of FIG. 4 may for example be used in a transmission system. FIG. 6 illustrates an example of a transmission system for communication of an audio signal in accordance with some embodiments of the invention. The transmission system comprises a transmitter 601 which is coupled to a receiver 603 through a network 605 which specifically may be the Internet.

In the specific example, the transmitter 601 is a signal recording device and the receiver 603 is a signal player device but it will be appreciated that in other embodiments a transmitter and receiver may used in other applications and for other purposes. For example, the transmitter 601 and/or the receiver 603 may be part of a transcoding functionality and may e.g. provide interfacing to other signal sources or destinations. Specifically, the receiver 603 may receive an encoded surround sound signal and generate an encoded binaural signal emulating the surround sound signal. The encoded binaural signal may then be distributed to other sources.

In the specific example where a signal recording function is supported, the transmitter 601 comprises a digitizer 607 which receives an analog multi-channel (surround) signal that is converted to a digital PCM (Pulse Code Modulated) signal by sampling and analog-to-digital conversion.

Figure 1:
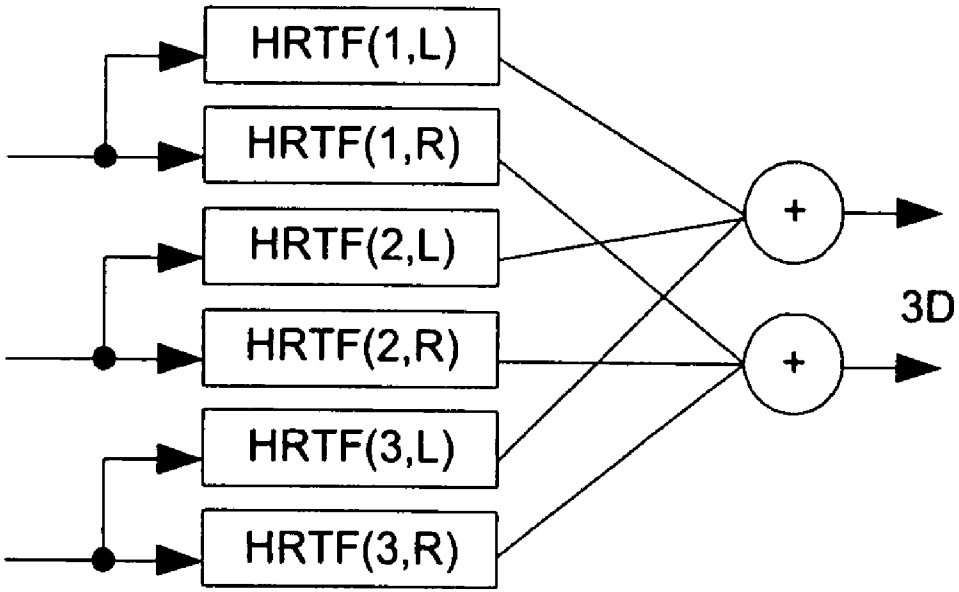
Prior Art FIG. 1
FIG. 1 is an illustration of an approach for generation of a binaural signal in accordance with conventional technology.
Figure 2:
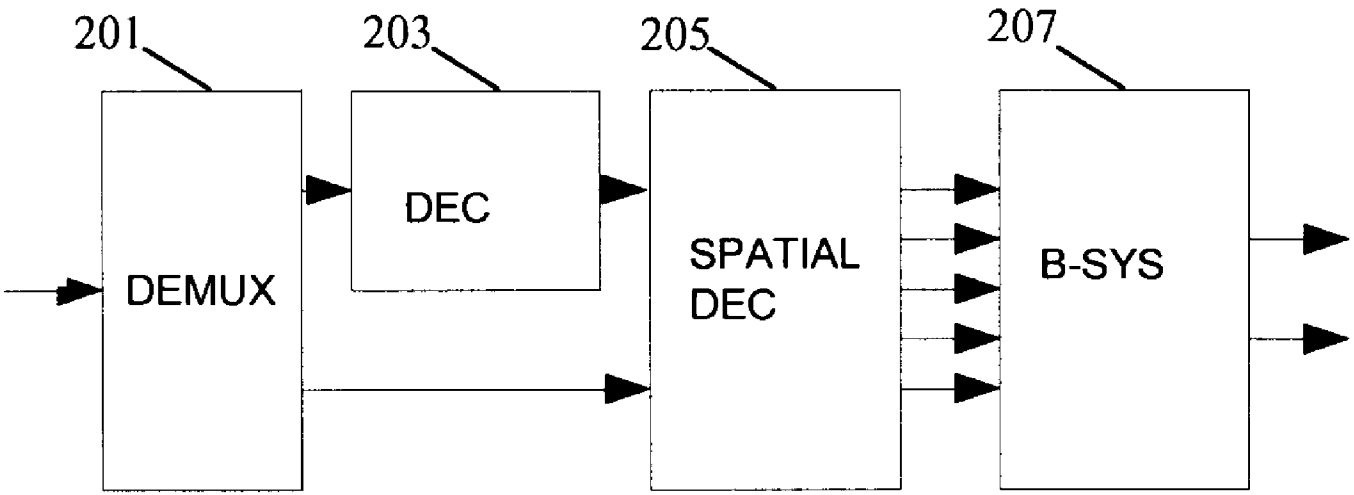
FIG. 2 Prior Art
FIG. 2 is an illustration of an approach for generation of a binaural signal in accordance with conventional technology.

The digitizer 607 is coupled to the encoder 609 of FIG. 1 which encodes the PCM multi channel signal in accordance with an encoding algorithm. In the specific example, the encoder 609 encodes the signal as an MPEG encoded surround sound signal. The encoder 609 is coupled to a network transmitter 611 which receives the encoded signal and interfaces to the Internet 605. The network transmitter may transmit the encoded signal to the receiver 603 through the Internet 605.

The receiver 603 comprises a network receiver 613 which interfaces to the Internet 605 and which is arranged to receive the encoded signal from the transmitter 601.

The network receiver 613 is coupled to a binaural decoder 615 which in the example is the device of FIG. 4.

In the specific example where a signal playing function is supported, the receiver 603 further comprises a signal player 1617 which receives the binaural audio signal from the binaural decoder 615 and presents this to the user. Specifically, the signal player 117 may comprise a digital-to-analog converter, amplifiers and speakers for outputting the binaural audio signal to a set of headphones.

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features may be worked and in particular the order of individual steps in a method claim does not imply that the steps may be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a binaural audio signal, the apparatus comprising:

a receiver for receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal;

a parameter data converter for converting spatial parameters of the spatial parameter data into first binaural parameters in response to at least one binaural perceptual transfer function;

an M-channel converter for converting the M-channel audio signal into a first stereo signal in response to the first binaural parameters;

a stereo filter for generating the binaural audio signal by filtering the first stereo signal; and a coefficient determiner for determining filter coefficients for the stereo filter in response to the binaural perceptual transfer function.

2. The apparatus of claim 1 further comprising:

a transformer for transforming the M-channel audio signal from a time domain to a subband domain and wherein the M-channel converter and the stereo filter is arranged to individually process each subband of the subband domain.

3. The apparatus of claim 2 wherein a duration of an impulse response of the binaural perceptual transfer function exceeds a transform update interval.

4. The apparatus of claim 2 wherein the M-channel converter is arranged to generate, for each subband, stereo output samples substantially as:

$$\begin{bmatrix} L_o \\ R_o \end{bmatrix} = \begin{bmatrix} h_{11} & h_{12} \\ h_{21} & h_{22} \end{bmatrix} \begin{bmatrix} L_I \\ R_I \end{bmatrix},$$

wherein at least one of $L_I$ and $R_I$ is a sample of an audio channel of the M-channel audio signal in the subband and the M-channel converter is arranged to determine matrix coefficients $h_{xy}$ in response to both the spatial parameter data and the at least one binaural perceptual transfer function.

5. The apparatus of claim 2 wherein the coefficient determiner comprises:

a provider for providing subband representations of impulse responses of a plurality of binaural perceptual transfer functions corresponding to different sound sources in the N-channel signal;

a filter coefficients determiner for determining the filter coefficients by a weighted combination of corresponding coefficients of the subband representations; and a weights determiner for determining weights for the subband representations for the weighted combination in response to the spatial parameter data.

6. The apparatus of claim 1 wherein the first binaural parameters comprise coherence parameters indicative of a correlation between channels of the binaural audio signal.

7. The apparatus of claim 1 wherein the first binaural parameters do not comprise at least one of localization parameters indicative of a location of any sound source of the N-channel signal and reverberation parameters indicative of a reverberation of any sound component of the binaural audio signal.

8. The apparatus of claim 1 wherein the coefficient determiner is arranged to determine the filter coefficients to reflect at least one of localization cues and reverberation cues for the binaural audio signal.

9. The apparatus of claim 1 wherein the audio M-channel audio signal is a mono audio signal and the M-channel converter is arranged to generate a decorrelated signal from the mono audio signal and to generate the first stereo signal by a matrix multiplication applied to samples of a stereo signal comprising the decorrelated signal and the mono audio signal.

10. A method of generating a binaural audio signal, the method comprising receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal;

converting spatial parameters of the spatial parameters data into first binaural parameters in response to at least one binaural perceptual transfer function;

converting the M-channel audio signal into a first stereo signal in response to the first binaural parameters;

generating the binaural audio signal by filtering the first stereo signal; and determining filter coefficients for the stereo filter in response to the at least one binaural perceptual transfer function.

11. A transmitter for transmitting a binaural audio signal, the transmitter comprising:

a receiver for receiving audio data comprising an M-channel, M being any integer greater than or equal to 1, audio signal being a downmix of an N-channel N being any integer greater than or equal to 1, audio signal and spatial parameter data for upmixing the M-channel audio signal to the N-channel audio signal;

a parameter data converter for converting spatial parameters of the spatial parameter data into first binaural parameters in response to at least one binaural perceptual transfer function;

an M-channel converter for converting the M-channel audio signal into a first stereo signal in response to the first binaural parameters;

a stereo filter for generating the binaural audio signal by filtering the first stereo signal;

a coefficient determiner for determining filter coefficients for the stereo filter in response to the binaural perceptual transfer function; and a transmitter for transmitting the binaural audio signal.

12. A transmission system for transmitting an audio signal, the transmission system comprising a transmitter comprising:

a receiver for receiving audio data comprising an M-channel, M being any integer greater than or equal to 1, audio signal being a downmix of an N-channel N being any integer greater than or equal to 1, audio signal and spatial parameter data for upmixing the M-channel audio signal to the N-channel audio signal, a parameter data converter for converting spatial parameters of the spatial parameter data into first binaural parameters in response to at least one binaural perceptual transfer function, an M-channel converter for converting the M-channel audio signal into a first stereo signal in response to the first binaural parameters, a stereo filter for generating the binaural audio signal by filtering the first stereo signal, a coefficient determiner for determining filter coefficients for the stereo filter in response to the binaural perceptual transfer function, and a transmitter for transmitting the binaural audio signal; and a receiver for receiving the binaural audio signal.

13. An audio recording device for recording a binaural audio signal, the audio recording device comprising:

a receiver for receiving audio data comprising an M-channel, M being any integer greater than or equal to 1, audio signal being a downmix of an N-channel N being any integer greater than or equal to 1, audio signal and spatial parameter data for upmixing the M-channel audio signal to the N-channel audio signal;

a parameter data converter for converting spatial parameters of the spatial parameter data into first binaural parameters in response to at least one binaural perceptual transfer function;

an M-channel converter for converting the M-channel audio signal into a first stereo signal in response to the first binaural parameters;

a stereo filter for generating the binaural audio signal by filtering the first stereo signal;

a coefficient determiner for determining filter coefficients for the stereo filter in response to the binaural perceptual transfer function; and a recorder for recording the binaural audio signal.

14. A method of transmitting a binaural audio signal, the method comprising:

receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal;

converting spatial parameters of the spatial parameter data into first binaural parameters in response to at least one binaural perceptual transfer function;

converting the M-channel audio signal into a first stereo signal in response to the first binaural parameters;

generating the binaural audio signal by filtering the first stereo signal in a stereo filter;

determining filter coefficients for the stereo filter in response to the binaural perceptual transfer function; and transmitting the binaural audio signal.

15. A method of transmitting and receiving a binaural audio signal, the method comprising:

receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal, converting spatial parameters of the spatial parameter data into first binaural parameters in response to at least one binaural perceptual transfer function, converting the M-channel audio signal into a first stereo signal in response to the first binaural parameters, generating the binaural audio signal by filtering the first stereo signal in a stereo filter, determining filter coefficients for the stereo filter in response to the binaural perceptual transfer function, and transmitting the binaural audio signal.

16. A tangible computer readable medium including a computer program for performing, when the computer program is executed by a computer, a method of transmitting a binaural audio signal, the method comprising:

receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal;

converting spatial parameters of the spatial parameter data into first binaural parameters in response to at least one binaural perceptual transfer function;

converting the M-channel audio signal into a first stereo signal in response to the first binaural parameters;

generating the binaural audio signal by filtering the first stereo signal in a stereo filter;

determining filter coefficients for the stereo filter in response to the binaural perceptual transfer function; and transmitting the binaural audio signal.

17. A tangible computer readable medium including a computer program for performing, when the computer program is executed by a computer, a method of transmitting and receiving a binaural audio signal, the method comprising:

receiving audio data comprising an M-channel, M being any integer greater than or equal to 1, audio signal being a downmix of an N-channel, N being any integer greater than or equal to 1, audio signal and spatial parameter data for upmixing the M-channel audio signal to the N-channel audio signal, converting spatial parameters of the spatial parameter data into first binaural parameters in response to at least one binaural perceptual transfer function, converting the M-channel audio signal into a first stereo signal in response to the first binaural parameters, generating the binaural audio signal by filtering the first stereo signal in a stereo filter, determining filter coefficients for the stereo filter in response to the binaural perceptual transfer function, and transmitting the binaural audio signal.

* * * * *